US012491423B2

(12) United States Patent
Olson et al.

(10) Patent No.: US 12,491,423 B2
(45) Date of Patent: Dec. 9, 2025

(54) DUMBBELL SUPPORTING SYSTEM

(71) Applicant: PowerBlock Holdings, Inc., Owatonna, MN (US)

(72) Inventors: Gregory Scott Olson, Owatonna, MN (US); Carl K. Towley, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 18/666,298

(22) Filed: May 16, 2024

(65) Prior Publication Data

US 2024/0299826 A1 Sep. 12, 2024

Related U.S. Application Data

(63) Continuation of application No. 17/558,737, filed on Dec. 22, 2021, now Pat. No. 12,029,958.

(51) Int. Cl.
*A63B 21/072* (2006.01)
*A63B 71/00* (2006.01)

(52) U.S. Cl.
CPC ..... *A63B 71/0036* (2013.01); *A63B 21/0726* (2013.01); *A63B 2225/093* (2013.01)

(58) Field of Classification Search
CPC ..... A63B 71/0036; A63B 21/0726; A63B 2225/093; A63B 21/06; A63B 21/072–08
See application file for complete search history.

(56) References Cited

U.S. PATENT DOCUMENTS 4,666,150 A * 5/1987 Segrist ..... A63B 21/078 211/85.7
5,472,397 A * 12/1995 Ammoscato ..... A63B 21/078 482/104
5,725,460 A * 3/1998 Marsh ..... A63B 71/0036 482/104
5,954,619 A * 9/1999 Petrone ..... A63B 71/0036 482/106
6,149,556 A * 11/2000 Jordan ..... A63B 71/0036 482/106
7,001,314 B1 2/2006 Hummer, Jr.
7,070,547 B1 * 7/2006 Pater ..... A63B 21/4029 482/142
7,285,077 B1 * 10/2007 Marx ..... A63B 21/0783 482/142
10,974,091 B1 4/2021 Hensler
11,103,739 B2 8/2021 Shaw, Jr.
(Continued)

FOREIGN PATENT DOCUMENTS

GB 2478769 9/2011

OTHER PUBLICATIONS

International Search Report and Written Opinion for Application No. PCT/US2022/082251 mailed Mar. 29, 2023.

*Primary Examiner* — Megan Anderson
*Assistant Examiner* — Catrina A Letterman
(74) *Attorney, Agent, or Firm* — Merchant & Gould P.C.

(57) ABSTRACT

A dumbbell supporting system includes a platform having an upper surface and a lower surface. The upper surface receives a dumbbell. A mount is removably attached to a post has a vertical orientation. An arm is attached to and extends between the mount and the platform. The platform is pivotally coupled to the arm and the mount is pivotally coupled to the arm.

13 Claims, 9 Drawing Sheets

(56) References Cited

U.S. PATENT DOCUMENTS

| | | | | |
|---|---|---|---|---|
| 11,571,602 | B1 | 2/2023 | Krueger | |
| 2007/0099773 | A1* | 5/2007 | Hummer | A63B 21/078 482/104 |
| 2009/0305851 | A1* | 12/2009 | Sukup | A63B 21/078 482/104 |
| 2012/0157271 | A1* | 6/2012 | Bauer | A63B 71/0036 482/104 |
| 2014/0121073 | A1* | 5/2014 | Hardy | A63B 21/078 482/104 |
| 2014/0128229 | A1* | 5/2014 | York | A63B 21/078 482/104 |
| 2016/0107020 | A1* | 4/2016 | Donato | A63B 21/0726 482/94 |
| 2018/0178051 | A1* | 6/2018 | Shaw, Jr. | A63B 21/078 |
| 2019/0275363 | A1* | 9/2019 | Jones | A63B 21/06 |
| 2020/0261759 | A1* | 8/2020 | Downing | A63B 21/0783 |
| 2020/0346063 | A1 | 11/2020 | Shaw, Jr. | |
| 2023/0123730 | A1 | 4/2023 | Downing | |

* cited by examiner

DUMBBELL SUPPORTING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise weight holding device and more particularly pertains to a new exercise weight holding device for placing dumbbells in a location that they can be easily gripped and used while performing other exercises. The device will also position the dumbbells in a vertically spaced position relative to a floor surface to prevent the requirement that a user bend over to retrieve the dumbbells.

(2) Description of Related Art Including Information Disclosed Under 37 CFR 1.97 and 1.98

The prior art relates to exercise weight holding devices that are mountable on other exercise equipment. While such devices allow for the vertical storage of an exercise weight, their limitations to movement of the weights while either being used or stored has been limited.

BRIEF SUMMARY OF THE INVENTION

An embodiment of the disclosure meets the needs presented above by generally comprising a platform having an upper surface and a lower surface. The upper surface is configured for receiving the dumbbell. A mount is removably attached to a post has a vertical orientation. An arm is attached to and extends between the mount and the platform. The platform is pivotally coupled to the arm and the mount is pivotally coupled to the arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
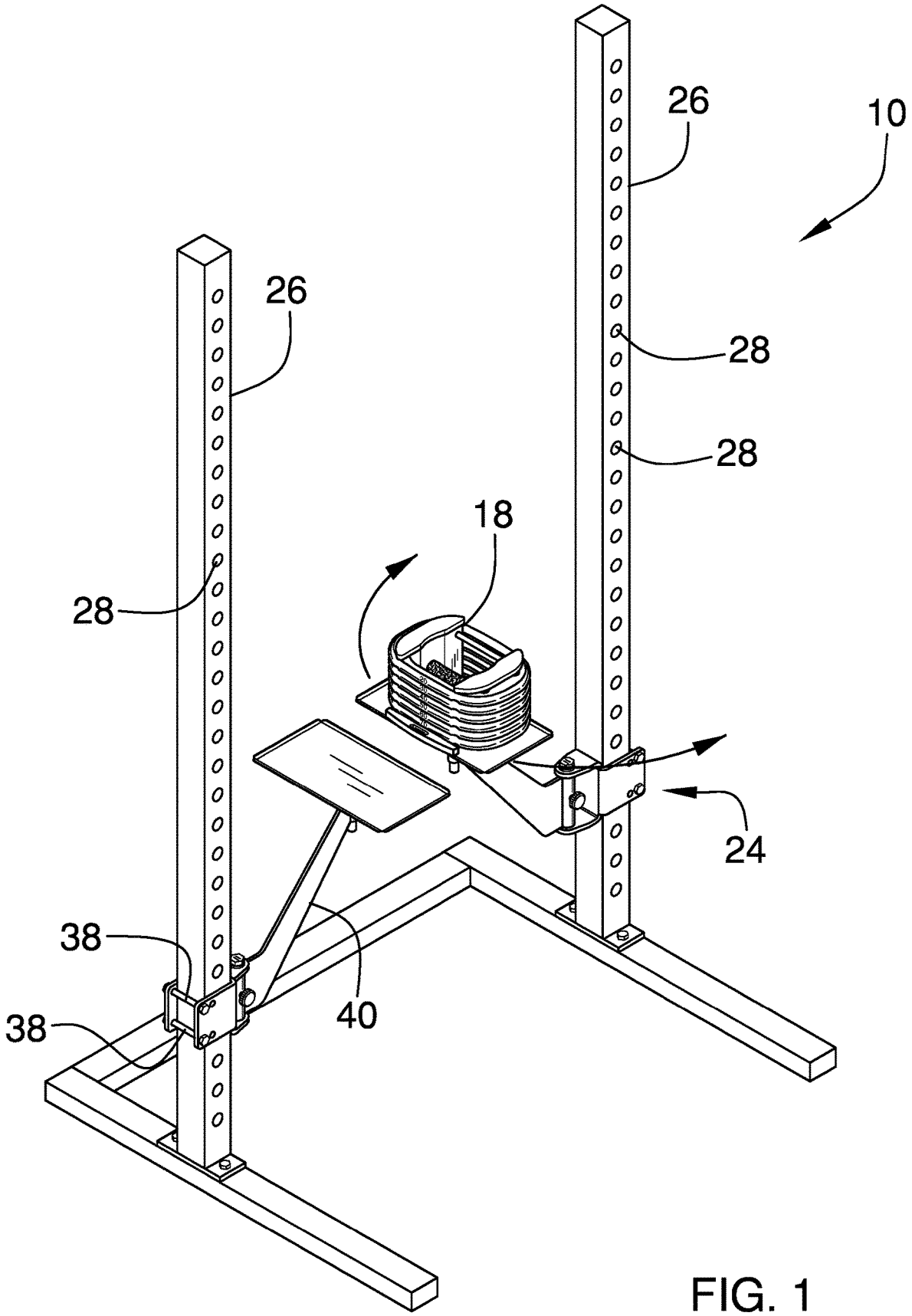
FIG. 1 is a front isometric view of a dumbbell supporting system according to an embodiment of the disclosure.
Figure 2:
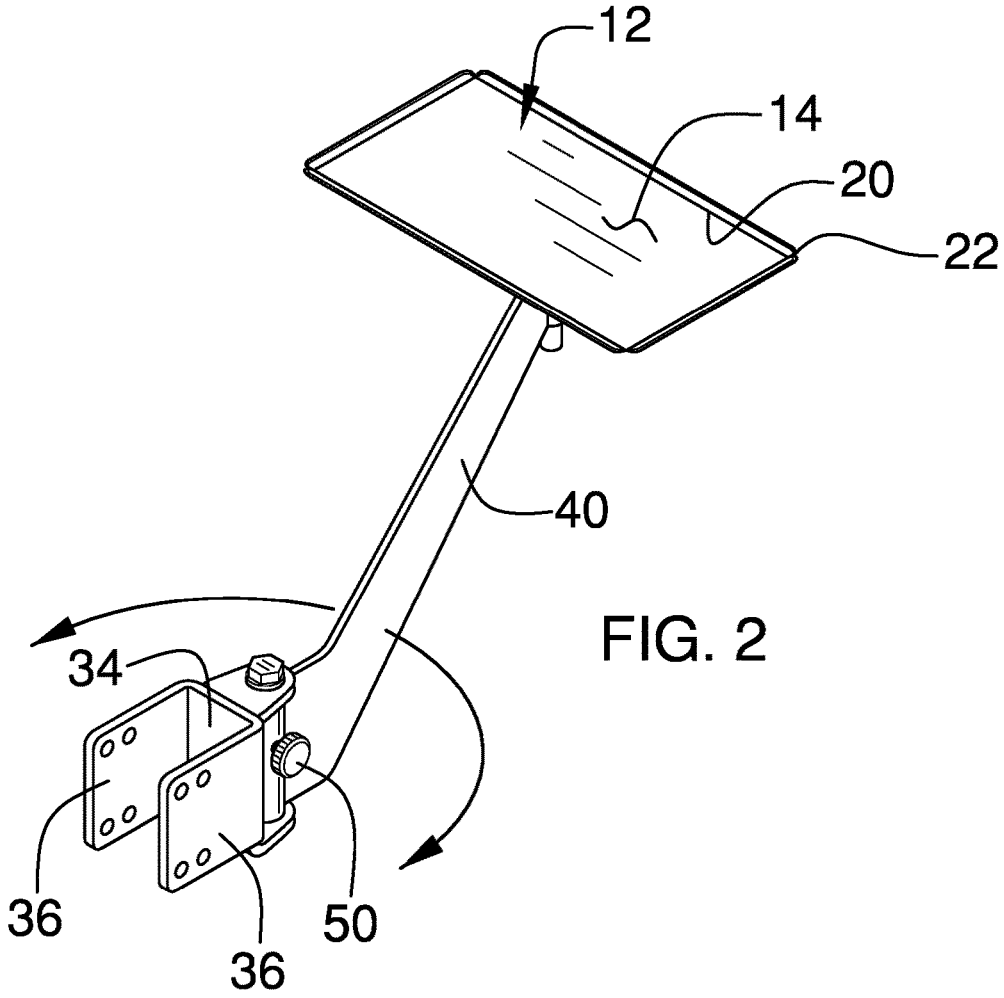
FIG. 2 is a rear and top isometric view of an embodiment of the disclosure.
Figure 3:
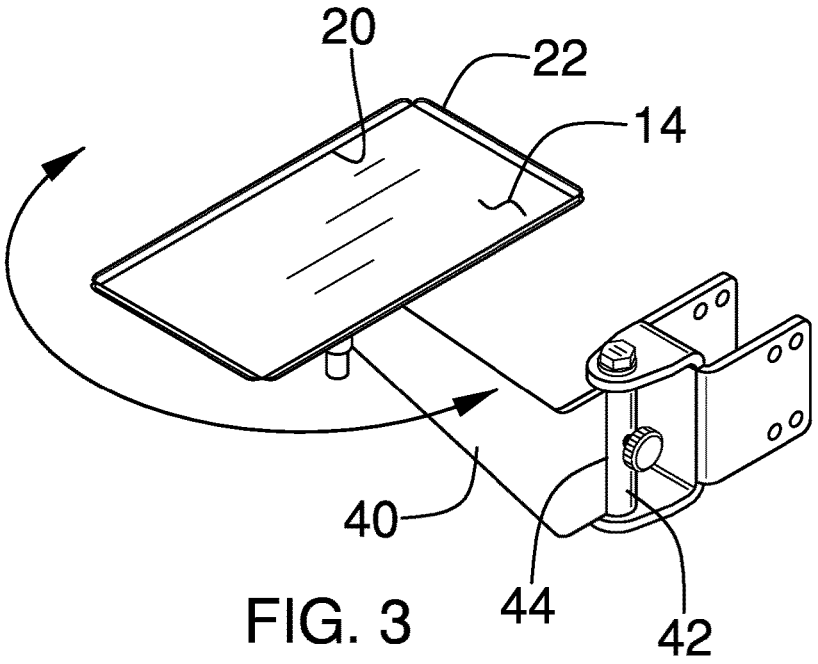
FIG. 3 is a front and top isometric view of an embodiment of the disclosure.

With reference now to the drawings, and in particular to FIGS. 1 through 10 thereof, a new exercise weight holding device embodying the principles and concepts of an embodiment of the disclosure and generally designated by the reference numeral 10 will be described.

As best illustrated in FIGS. 1 through 10, the dumbbell supporting system 10 generally comprises a platform 12 having an upper surface 14 and a lower surface 16, wherein the upper surface 14 is configured for receiving and supporting a dumbbell 18 above a floor surface. The upper surface 14 of the platform 12 will typically have a length and a width each preferably being no more than 18 inches, more preferably no more than 24 inches, and most preferably no more than 30 inches. Each length and width dimension is also typically more than 5.0 inches, though the size of the upper surface 14 may depend on the particular type of exercise weight the user is utilizing as well as the area in which the system 10 is mounted. Thus, a platform 12 for use with kettlebells may have a smaller size and a shape configured for such. The upper surface 14 will typically be planar and horizontally orientated though embodiments are envisioned wherein the platform 12 will have a contoured shape depending on the type of weight lifting equipment it is to be used with. The upper surface 14 has a perimeter edge 20. A perimeter lip 22 may be coextensive with the perimeter edge 20 which extends upwardly from the upper surface 14.

The platform 12 may be made out of any rigid, high strength material though metals, such as steel, will typically be utilized.

Figure 10:
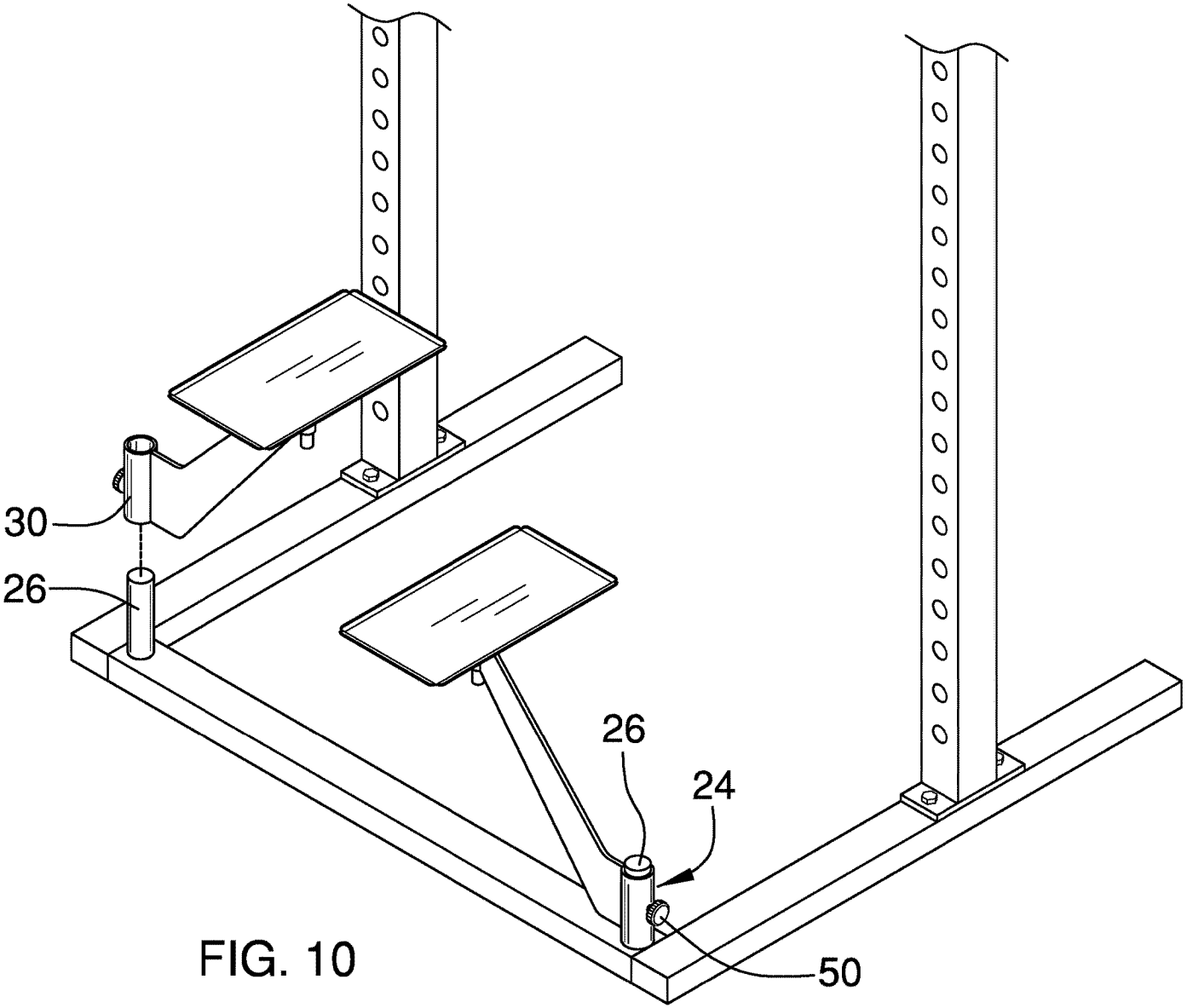
FIG. 10 is a rear isometric view of another embodiment of the disclosure.

A mount 24 is removably attached to a post 26 most often having a vertical orientation. However, the mount 24 and post 26 may each being angled such that the platform 12 is at a horizontal or other desired angle. The post 26 will typically be mounted to or comprise a supporting element of exercise equipment. Thus, the post 26 may comprise a support pillar for a squat rack or the base of the squat rack. Weight stacks mounted within pulley systems will also often include the types of vertically orientated supports that may be utilized as the post 26. While any post 26 of high strength and durability may be used, squat racks may be preferred due to their stability, relative position of convenience to a person exercising, and typically include aligned apertures 28 which can be utilized for attachment purposes. The mount 24 includes a sleeve 30 for receiving the post 26. In one embodiment, the mount 24 comprises a bracket 32 including a front wall 34 and a pair of lateral walls 36 attached to and extending away from the front wall 34. The post 26 is positioned between the lateral walls 36 and a fastener 38 extends through each of the lateral walls 36 to releasably secure the mount 24 to the post 26. The fastener 38 may be used frictionally tighten the lateral walls 36 to the post 26, and/or the fastener 38 may be extended through the post 26. Some embodiments may include a single fastener 38, functioning as a pin, that is extendable through the mount 24 and one of the apertures 28. The sleeve 30 may include a complete tube having a rectangular shape for engaging similarly shaped posts 26 of squat racks or may be cylindrical as shown in FIG. 10.

An arm 40 is attached to and extends between the mount 24 and the platform 12. The platform 12 is pivotally coupled to the arm 40 and the mount 24 is also pivotally coupled to the arm 40. This ability to pivot in two locations allows the user to manipulate the exercise weight, such as the dumbbell 18, relative to the arm 40 while also moving the arm 40 relative to the post 26. Thus, the platform 12 can be moved out of the way when not needed or moved and rotated relative to a user's body to place the dumbbell 18 in a location convenient for a particular exercise. Typically, the arm 40 extends laterally away from the mount a distance between 4 inches and 36 inches, though this measurement may vary depending on a distance between posts 26, as shown in FIG. 1. Since the system 10 will usually be used in pairs, the arm length 40 may be a function of where the platforms 12 are positionable relative to a person standing near or between the posts 26.

The arm 40 may be angled with respect to a horizontal plane from the mount 24 to the platform 12. The arm 40, in some embodiments, forms an angle with a horizontal plane between 25° and 75°, and will is angled upwardly from the mount 24 to keep the arm 40 away from the user while the user performs lifting exercises. However, the arm 40 may extend perpendicular to or downwardly from the mount 24.

Figure 4:
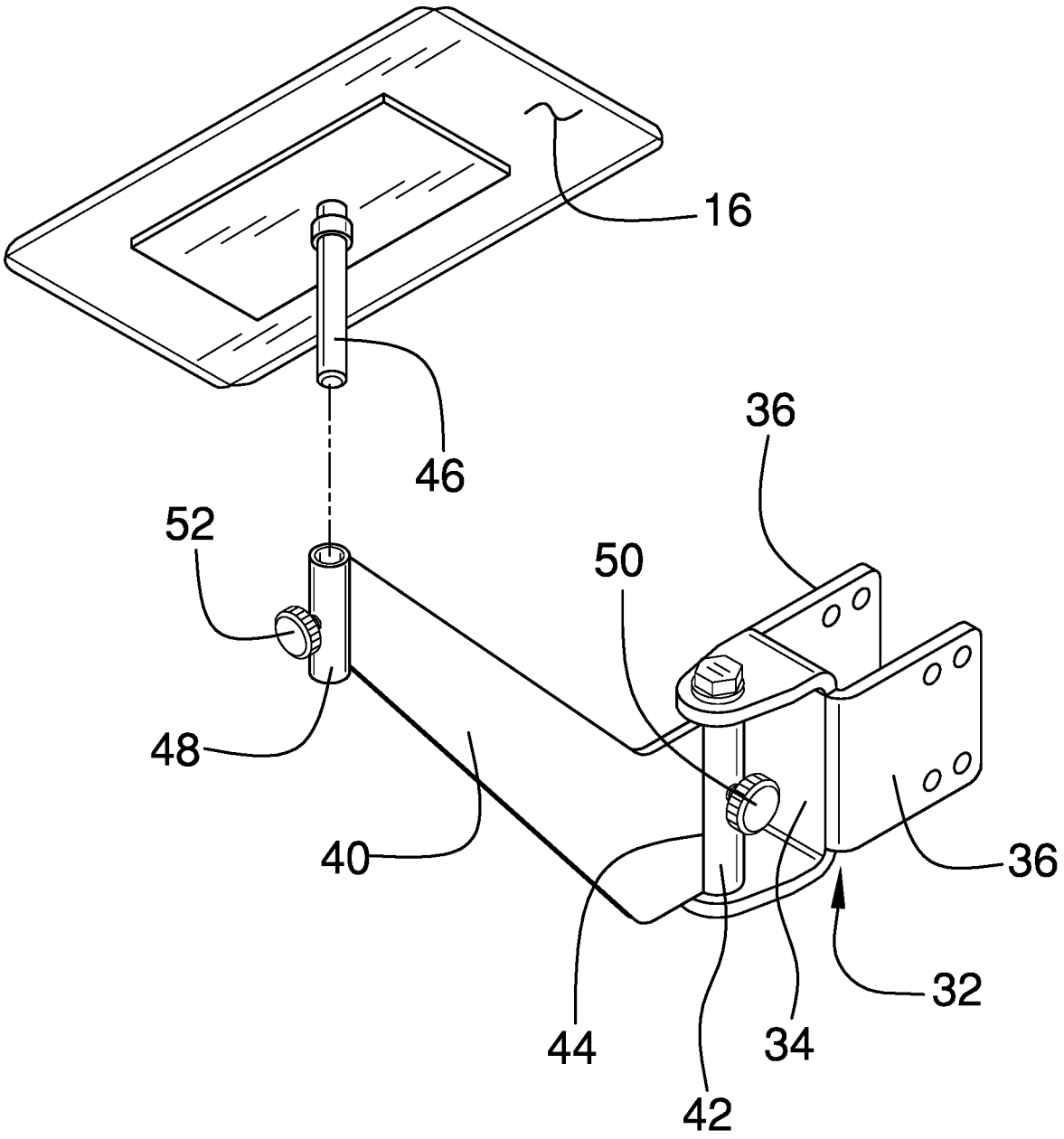
FIG. 4 is a side isometric view of an embodiment of the disclosure.
Figure 5:
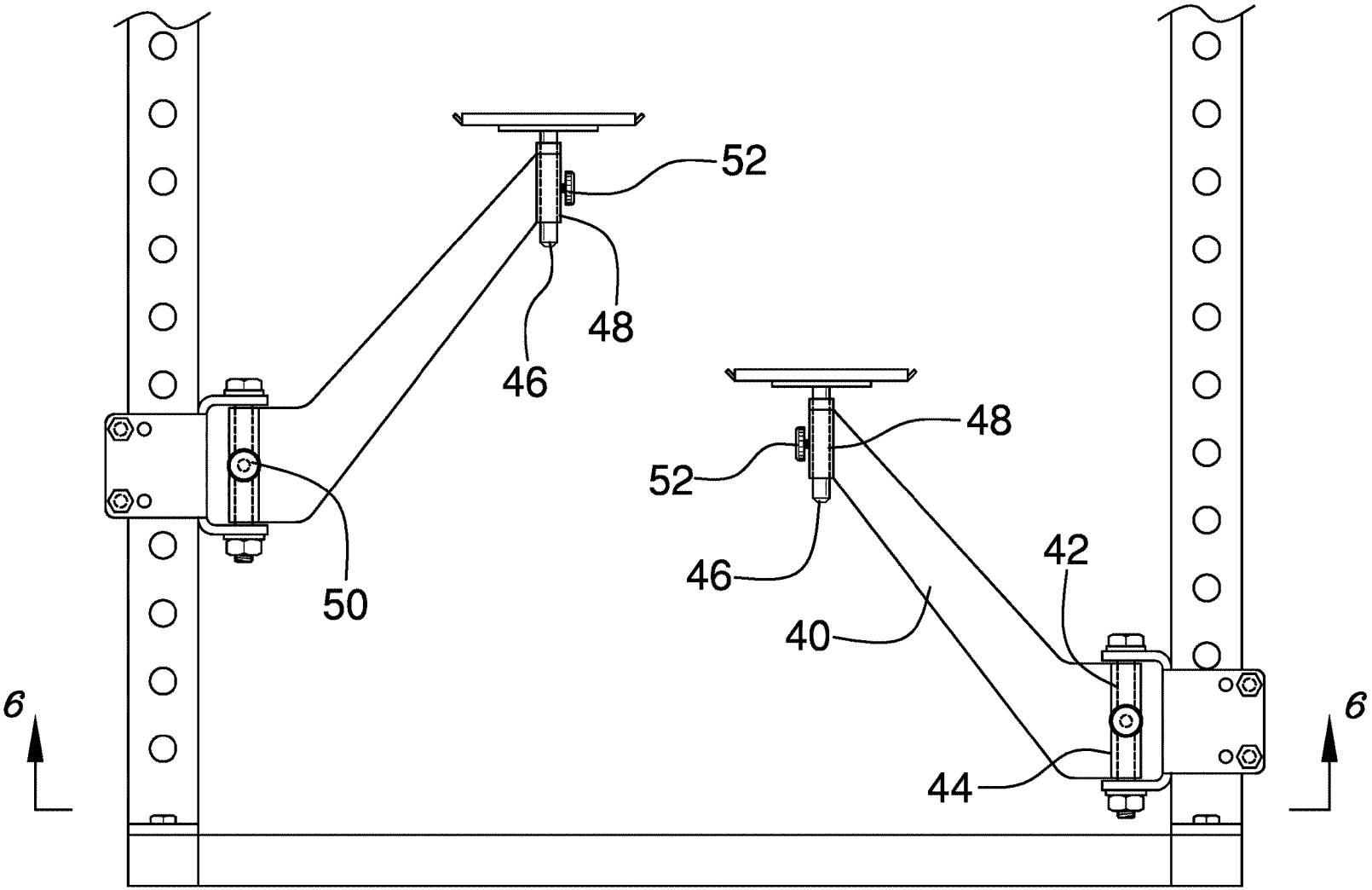
FIG. 5 is a front view of an embodiment of the disclosure.
Figure 6:
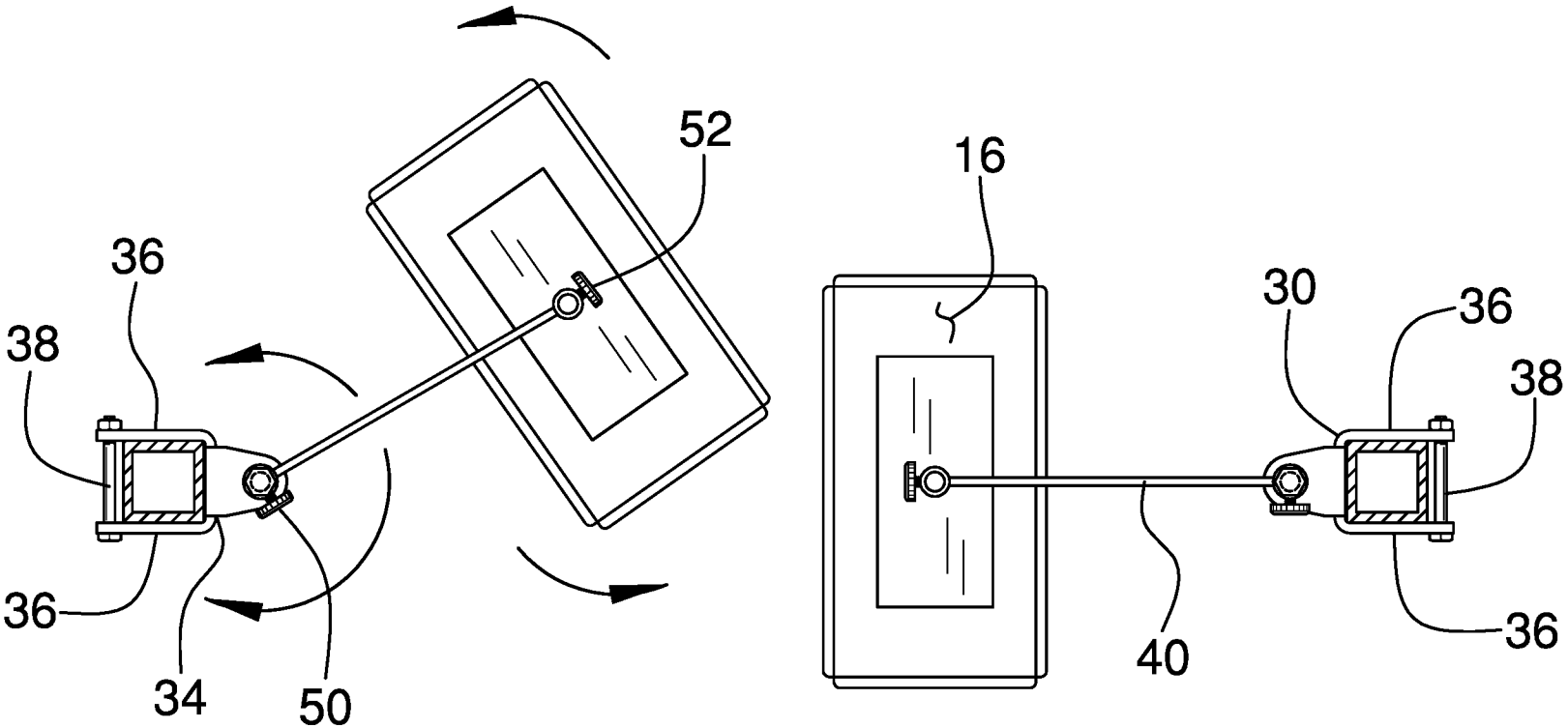
FIG. 6 is a bottom view of an embodiment of the disclosure taken along line 6-6 of FIG. 5.
Figure 7:
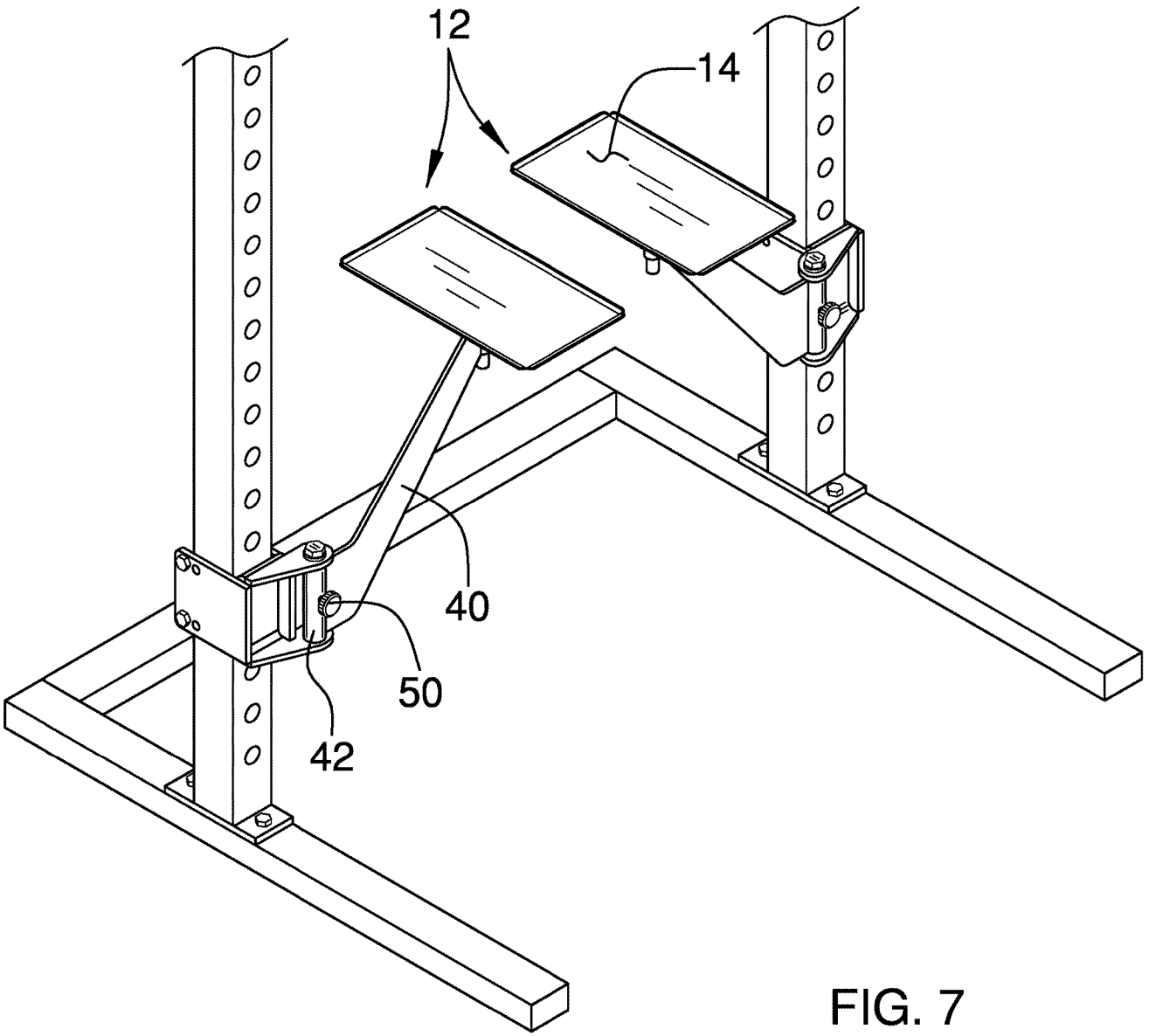
FIG. 7 is a top isometric view of an embodiment of the disclosure including an offset hinge.

A hinge 42 is attached to the mount 24 and is also attached to a proximal end 44 of the arm 40 with respect to the mount 24. The hinge 42 is vertically orientated and will typically be mounted on an exterior surface of the mount 42, and, more specifically, on the front wall 34 if the mount 24 has a rectangular or U-shaped configuration. The hinge 42 may be any conventional hinge. AT-hinge may be utilized as shown in FIG. 4, since such a hinge may be removed from its pin and instead be used directly with the post 26 as shown in FIG. 10. In such an embodiment, the hinge 42 defines the mount 24 for the purpose of connecting the arm 40 to the post 26. When using a mount 24 as shown in FIG. 4, the arm 40 is pivotable at least 180° with respect to the mount 24. As is shown in FIG. 7, the hinge 42 may be laterally offset from the mount 24 and such may be dependent or desirous depending on the type of post 26 being utilized.

A spindle 46 rotatably engages the platform 12 with the arm 40 distal to the mount 24. The spindle 46 is vertically orientated and is attached to and extends downwardly from the lower surface 16. The proximal end 48 of the arm 40 comprises a tube receiving the spindle 46. The platform 12 is rotatable 360° with respect to the proximal end 48. A restrictor 50 may be mechanically coupled to the hinge 42 and is actuated to restrict pivoting of the arm 40 relative to the mount 24. Additionally, a locking member 52 may be mechanically coupled to the spindle 46 and is actuated to restrict pivoting of the platform 12 relative to the arm 40. The locking member 52 and restrictor 50 may be any conventional mechanical structure utilized to restrict rotation of the arm 40 or platform 12. As shown in the Figures, this may include, for example, a threaded rod extending into the hinge 42 or proximal end 48 that is rotated with a knob to frictionally engage the spindle 46 or pin of the hinge 42 to prevent rotation, though other conventional and analogous locking/redistricting structures utilized.

Figure 8:
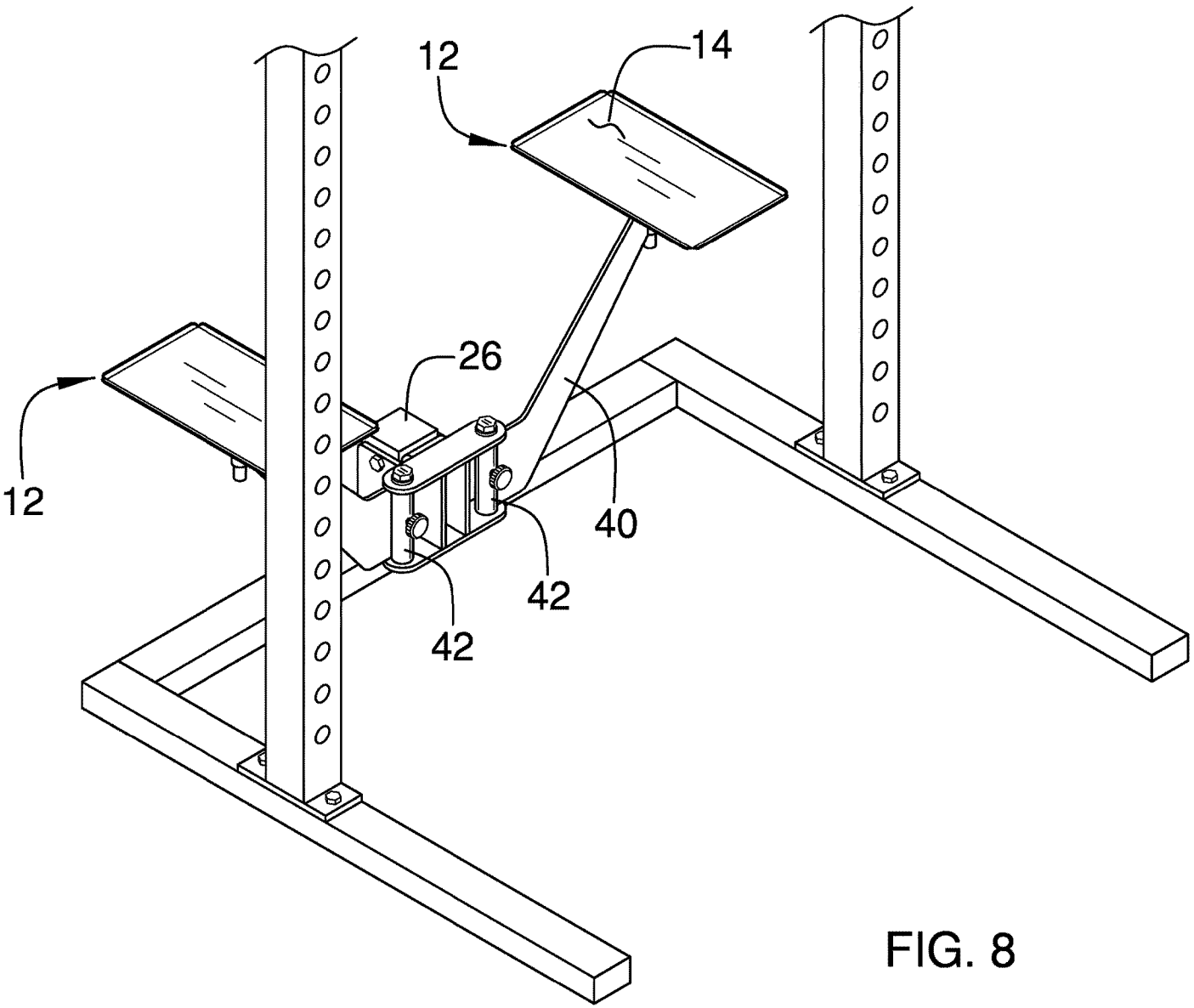
FIG. 8 is a front isometric view of an embodiment of the disclosure including a pair of arms and platforms.
Figure 9:
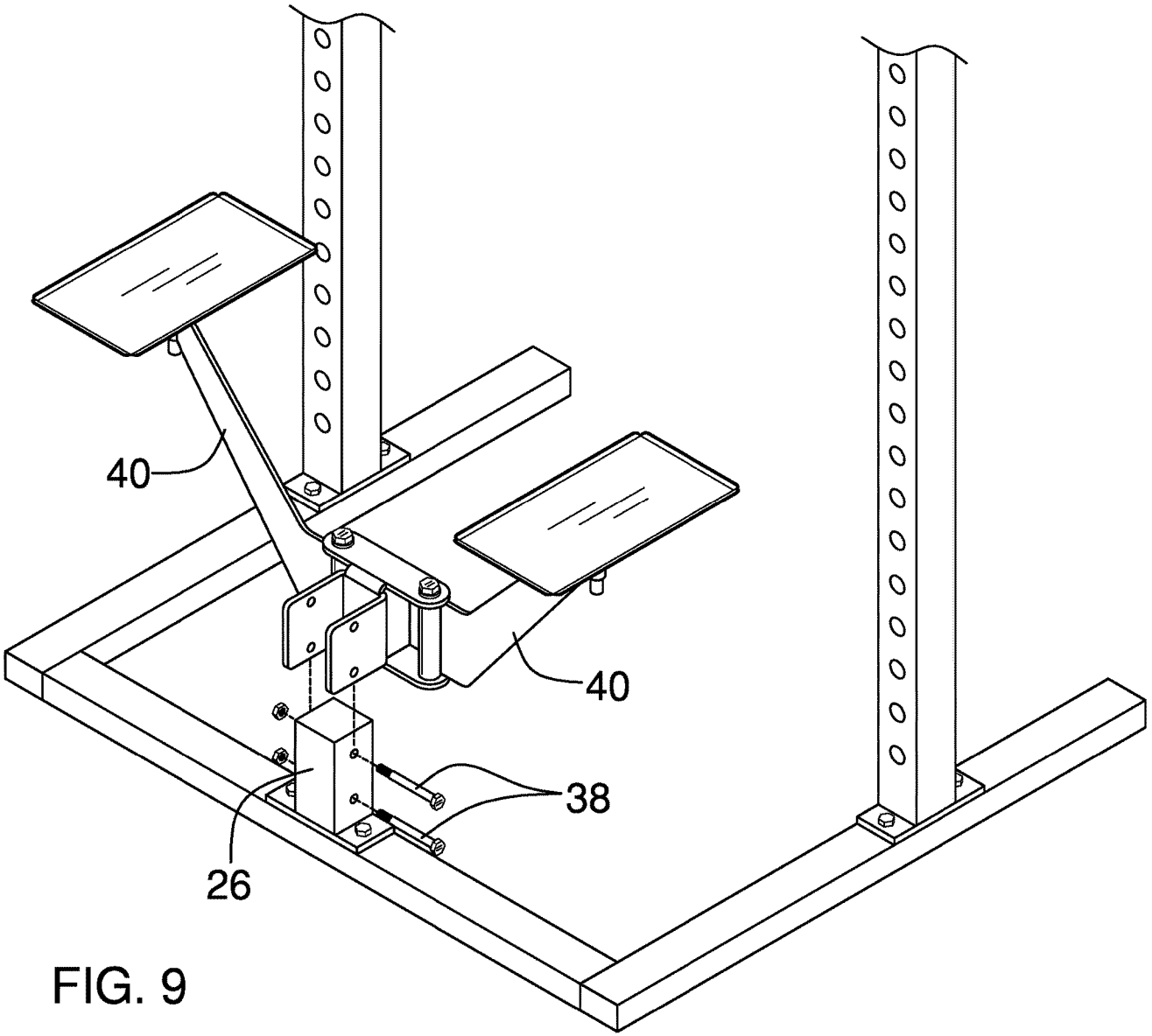
FIG. 9 is a rear isometric view of the embodiment of the disclosure shown in FIG. 8.

In the embodiment of FIGS. 8 and 9, a single mount 24 is utilized with a pair of arms 40 each terminating in a platform 12. This type of embodiment would typically be utilized with the base of the squat rack and positioned on a centrally located post 26 attached to the base. This embodiment also places the hinges 42 in a laterally spaced location relative to the front wall 34.

In use, the mount 24 is attached to the post 26 and this may be effected as described above and is dependent on the type of post 26 being utilized. Should the post 26 be of the type used for squat racks, or other similarly elongated vertical type posts, the mount 24 may be vertically positioned where needed. This vertical position of the mount 24 may be altered as needed and will place the dumbbell 18 at a height to prevent the need to constantly bend over to retrieve the dumbbell 18. The platform 12 is thereafter positioned where desired relative to the post 26 to facilitate either storage of the dumbbell 18 or to facilitate the dumbbell's 18 usage. The dumbbell 18 may be of the type including variable weight selection allowing the user to essentially store many weight options in a conveniently positioned location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

What is claimed is:

1. A support assembly for supporting weights, the support assembly comprising:

a first platform having a first upper surface being configured for receiving a first weight;

a second platform having a second upper surface being configured for receiving a second weight;

a mount being removably attached to a post;

a first arm being attached to and extending between the mount and the first platform;

a second arm being attached to and extending between the mount and the second platform;

a first hinge being attached to the mount and being attached to a first proximal end of the first arm with respect to the mount; and a second hinge being attached to the mount and being attached to a second proximal end of the second arm with respect to the mount;

wherein the first platform is independent of the second platform;

wherein each of the first hinge and the second hinge are vertically orientated and mounted on an exterior surface of the mount; and wherein each of the first platform and the second platform is rotatable 360°.

2. The support assembly of claim 1, wherein the post has a vertical orientation.

3. The support assembly of claim 2, wherein the first platform is pivotably coupled to the first arm and the second platform is pivotably coupled to the second arm.

4. The support assembly of claim 3, wherein the mount is pivotably coupled to the first arm and the mount is pivotably coupled to the second arm.

5. The support assembly of claim 1, wherein each of the first arm and the second arm extends laterally away from the mount a distance between 4 inches and 36 inches.

6. The support assembly of claim 5, wherein each of the first arm and the second arm is angled with respect to a horizontal plane from the mount to each of the first platform and the second platform, respectively, each of the first arm and the second arm forming an angle with the horizontal plane between 25° and 75°.

7. The support assembly of claim 6, wherein each of the first arm and the second arm are angled upwardly from the mount.

8. The support assembly of claim 1, wherein the mount includes a bracket including a front wall and a pair of lateral walls being attached to and extending away from the front wall, the post being positioned between the pair of lateral walls, a fastener extending through each wall of the pair of lateral walls to releasably secure the mount to the post.

9. The support assembly of claim 8, wherein the fastener extends through the post.

10. The support assembly of claim 1, wherein each of the first upper surface and the second upper surface has a length and a width each being no more than 30 inches.

11. The support assembly of claim 1, further comprising:

a first restrictor being mechanically coupled to the first hinge and being actuated to restrict pivoting of the first arm relative to the mount; and a second restrictor being mechanically coupled to the second hinge and being actuated to restrict pivoting of the second arm relative to the mount.

12. The support assembly of claim 1, further comprising:

a first locking member to restrict pivoting of the first platform relative to the first arm; and a second locking member to restrict pivoting of the second platform relative to the second arm.

13. A support assembly for supporting weights in an area adjacent to a workout space, the support assembly comprising:

a first platform having a first upper surface and a first lower surface, the first upper surface being configured for receiving a first weight;

a second platform having a second upper surface and a second lower surface, the second upper surface being configured for receiving a second weight;

a mount being removably attached to a post having a vertical orientation;

a first arm being attached to and extending between the mount and the first platform, the first platform being pivotally coupled to the first arm, the mount being pivotally coupled to the first arm;

a second arm being attached to and extending between the mount and the second platform, the second platform being pivotally coupled to the second arm, the mount being pivotally coupled to the second arm;

each of the first upper surface and the second upper surface having a length and a width each being no more than 30 inches, each of the first upper surface and the second upper surface being planar;

the mount including a bracket including a front wall and a pair of lateral walls being attached to and extending away from the front wall, the post being positioned between the pair of lateral walls, a fastener extending through each wall of the pair of lateral walls to releasably secure the mount to the post;

a first hinge being attached to the mount and being attached to a first proximal end of the first arm with respect to the mount, the first hinge being vertically orientated and being mounted on an exterior surface of the mount;

a second hinge being attached to the mount and being attached to a second proximal end of the second arm with respect to the mount, the second hinge being vertically orientated and being mounted on the exterior surface of the mount;

a first spindle rotatably engaging the first platform with the first arm distal to the mount, the first spindle being vertically orientated, the first spindle being attached to and extending downwardly from the first lower surface of the first platform;

a second spindle rotatably engaging the second platform with the second arm distal to the mount, the second spindle being vertically orientated, the second spindle being attached to and extending downwardly from the second lower surface of the second platform;

a first restrictor being mechanically coupled to the first hinge and being actuated to restrict pivoting of the first arm relative to the mount;

a second restrictor being mechanically coupled to the second hinge and being actuated to restrict pivoting of the second arm relative to the mount;

a first locking member being mechanically coupled to the first spindle and being actuated to restrict pivoting of the first platform relative to the first arm;

a second locking member being mechanically coupled to the second spindle and being actuated to restrict pivoting of the second platform relative to the second arm;

each of the first arm and the second arm extending laterally away from the mount a distance between 4 inches and 36 inches; and each of the first arm and the second arm being angled with respect to a horizontal plane from the mount to each of the first platform and the second platform, respectively, each of the first arm and the second arm forming an angle with the horizontal plane between 25° and 75°.

* * * * *